US007621405B2

(12) United States Patent
Schweitzer et al.

(10) Patent No.: US 7,621,405 B2
(45) Date of Patent: Nov. 24, 2009

(54) LITHIUM BATTERY PACKAGE

(75) Inventors: Andrew C. Schweitzer, Syracuse, NY (US); David J. Hine, Skaneateles, NY (US); Scott W. Osiecki, Skaneateles, NY (US); Mark A. Ferguson, Memphis, NY (US)

(73) Assignee: Eveready Battery Co., Inc., St. Louis, MO (US)

( * ) Notice: Subject to any disclaimer, the term of this patent is extended or adjusted under 35 U.S.C. 154(b) by 239 days.

(21) Appl. No.: 11/765,865

(22) Filed: Jun. 20, 2007

(65) Prior Publication Data

US 2008/0314791 A1 Dec. 25, 2008

(51) Int. Cl.
*B65D 85/00* (2006.01)
*B65D 73/00* (2006.01)

(52) U.S. Cl. ..... 206/703; 206/463; 206/470

(58) Field of Classification Search ..... 206/216, 206/223, 460–471, 548, 549, 568, 573, 703, 206/704, 705, 713, 714, 715, 775, 776, 778, 206/779, 806, 725

See application file for complete search history.

(56) References Cited

U.S. PATENT DOCUMENTS 610,522 A 9/1898 Brown
1,116,043 A 11/1914 Elliott
2,359,679 A 10/1944 Roehrl
2,790,587 A 4/1957 Contant
2,983,368 A * 5/1961 Vander Lugt, Jr. ..... 206/470
3,187,889 A 6/1965 Sinclair
3,298,515 A * 1/1967 Watts, Jr. ..... 206/469
3,408,758 A * 11/1968 Doring ..... 40/124.06
3,476,239 A 11/1969 Jacob (Continued)

FOREIGN PATENT DOCUMENTS

CA 2212112 2/1999

(Continued)

OTHER PUBLICATIONS

Patent Cooperation Treaty (PCT), International Search Report and Written Opinion for Application No. PCT/US2008/007252, filed Jun. 10, 2008, mailed Oct. 20, 2008, Korean Intellectual Property Office, Korea.

(Continued)

*Primary Examiner*—Stephen Garbe
*Assistant Examiner*—Dene Quest
(74) *Attorney, Agent, or Firm*—Russell H. Toye, Jr.

(57) ABSTRACT

A package comprising a first panel and a second panel. The first and second panels have a closed position wherein the first panel abuts the second panel and an open position wherein the first panel is spaced from the second panel. The first panel has a battery holder configured to retain at least one battery therein. The second panel has a battery powered device holder configured to retain a battery powered device therein. The first panel has a first tear away strip for allowing batteries in the battery holder to be removed from the first panel when the first and second panels are in the open position. The second panel has a second tear away strip for allowing the battery powered device in the battery powered device holder to be removed from the second panel when the first and second panels are in the open position.

43 Claims, 13 Drawing Sheets

U.S. PATENT DOCUMENTS

| | | | | | |
|---|---|---|---|---|---|
| 3,497,059 | A | * | 2/1970 | Watts, Jr. | 206/463 |
| 3,881,257 | A | | 5/1975 | Chasen | |
| 3,990,578 | A | | 11/1976 | Roeser | |
| 4,354,598 | A | | 10/1982 | Schilinger | |
| 4,549,654 | A | * | 10/1985 | Tiesman | 206/486 |
| 4,953,700 | A | | 9/1990 | DeDino | |
| 4,958,731 | A | | 9/1990 | Calcerano | |
| 5,119,952 | A | * | 6/1992 | Warriner, Jr. | 206/462 |
| 5,447,232 | A | * | 9/1995 | Chow | 206/378 |
| D394,806 | S | | 6/1998 | Budert | |
| 5,947,297 | A | | 9/1999 | Aoki et al. | |
| 6,039,185 | A | | 3/2000 | Pedracine et al. | |
| D429,634 | S | | 8/2000 | Pirro | |
| D432,009 | S | | 10/2000 | Pirro et al. | |
| D432,410 | S | | 10/2000 | Schwartz | |
| 6,152,303 | A | | 11/2000 | Ducote et al. | |
| D443,204 | S | | 6/2001 | Garrant et al. | |
| 6,244,444 | B1 | | 6/2001 | Jacobus et al. | |
| 6,308,832 | B1 | * | 10/2001 | Pirro et al. | 206/469 |
| D454,300 | S | | 3/2002 | Pirro et al. | |
| D454,783 | S | | 3/2002 | Pirro et al. | |
| D469,348 | S | | 1/2003 | Demus et al. | |
| 6,615,986 | B2 | * | 9/2003 | Pirro et al. | 206/704 |
| 6,669,020 | B1 | | 12/2003 | Mamiye | |
| 6,736,267 | B2 | * | 5/2004 | Schamante | 206/705 |
| D499,013 | S | | 11/2004 | Kessler | |
| D508,844 | S | | 8/2005 | Calcerano | |
| D510,261 | S | | 10/2005 | Calcerano | |

FOREIGN PATENT DOCUMENTS

| | | | |
|---|---|---|---|
| EP | 0473190 | | 3/1992 |
| JP | 11059724 | A | 2/1999 |
| JP | 200043936 | | 2/2000 |
| WO | 2004024589 | A1 | 3/2004 |
| WO | 2004060770 | A1 | 7/2004 |

OTHER PUBLICATIONS

Rayovac Loud 'n Clear Package Front (photo) published before Apr. 18, 2000.

Rayovac Loud 'n Clear Package Side (photo) published before Apr. 18, 2000.

Rayovac Loud 'n Clear Package Back (photo) published before Apr. 18, 2000.

Rayovac Loud 'n Clear Package Inside Front and Back (photo) published before Apr. 18, 2000.

* cited by examiner 44
10
64
28
32
30
30
92
94
16
76
22
92
96
26
32
116
52
105
111
104
106
40
51
106
98
30
54
94
34
38
24
116
101
50
72
12
100
48
116
102
116
10
55
70
56
79
58
68
39
36
42
108
66
57
78
14
69
64
110

LITHIUM BATTERY PACKAGE

FIELD OF THE INVENTION

The present invention relates to packaging, and in particular to a package for holding batteries and a flashlight.

SUMMARY OF THE INVENTION

One aspect of the present invention is to provide a package comprising a first panel having a first front surface and a first rear surface and a second panel pivotally connected to the first panel, with the second panel having a second front surface and a second rear surface. The first panel and the second panel have a closed position wherein the first panel abuts the second panel such that the first rear surface of the first panel abuts the second front surface of the second panel. The first panel and the second panel have an open position wherein the first rear surface of the first panel is spaced from the second front surface of the second panel. The first panel has an at least partially transparent battery holder, with the battery holder being configured to retain at least one battery therein. The battery holder is configured to allow the at least one battery to be seen from a front of the package when the first panel and the second panel are in the closed position. The second panel has an at least partially transparent device holder, with the device holder being configured to retain a device therein. The device holder is configured to allow the device to be seen from the front of the package when the first panel and the second panel are in the closed position. The device holder is further configured to allow the device to be seen from the front of the second panel when the first panel and the second panel are in the open position.

Another aspect of the present invention is to provide a package comprising a first panel having a first front surface and a first rear surface and a second panel pivotally connected to the first panel, with the second panel having a second front surface and a second rear surface. The first panel and the second panel have a closed position wherein the first panel abuts the second panel such that the first rear surface of the first panel abuts the second front surface of the second panel. The first panel and the second panel have an open position wherein the first rear surface of the first panel is spaced from the second front surface of the second panel. The first panel has an at least partially transparent battery holder and at least one battery in the battery holder, with the battery holder being configured to allow the at least one battery to be seen from a front of the package when the first panel and the second panel are in the closed position. The second panel has an at least partially transparent battery powered device holder and a battery powered device retained by the battery powered device holder, with the battery powered device holder being configured to allow the battery powered device to be seen from the front of the package when the first panel and the second panel are in the closed position. The battery powered device holder is further configured to allow the battery powered device to be seen from the front of the second panel when the first panel and the second panel are in the open position.

Yet another aspect of the present invention is to provide a package comprising a first panel having a first front surface and a first rear surface and a second panel pivotally connected to the first panel, with the second panel having a second front surface and a second rear surface. The first panel and the second panel have a closed position wherein the first panel abuts the second panel such that the first rear surface of the first panel abuts the second front surface of the second panel. The first panel and the second panel have an open position wherein the first rear surface of the first panel is spaced from the second front surface of the second panel. The first panel has a battery holder, with the battery holder being configured to retain at least one battery therein. The second panel has a device holder, with the device holder being configured to retain a device therein. The first panel has a first tear away strip at the first rear surface for allowing batteries in the at least partially transparent battery holder to be removed from the first panel when the first panel and the second panel are in the open position. The second panel has a second tear away strip at the second front surface for allowing the device in the device holder to be removed from the second panel when the first panel and the second panel are in the open position.

Another aspect of the present invention is to provide a package comprising a first panel having a first front surface and a first rear surface and a second panel pivotally connected to the first panel, with the second panel having a second front surface and a second rear surface. The first panel and the second panel have a closed position wherein the first panel abuts the second panel such that the first rear surface of the first panel abuts the second front surface of the second panel. The first panel and the second panel have an open position wherein the first rear surface of the first panel is spaced from the second front surface of the second panel. The first panel has a battery holder retaining at least one battery. The second panel has a battery powered device holder retaining a battery powered device. The first panel has a first tear away strip at the first rear surface for allowing the at least one battery in the battery holder to be removed from the first panel when the first panel and the second panel are in the open position. The second panel has a second tear away strip at the second front surface for allowing the battery powered device in the battery powered device holder to be removed from the second panel when the first panel and the second panel are in the open position.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
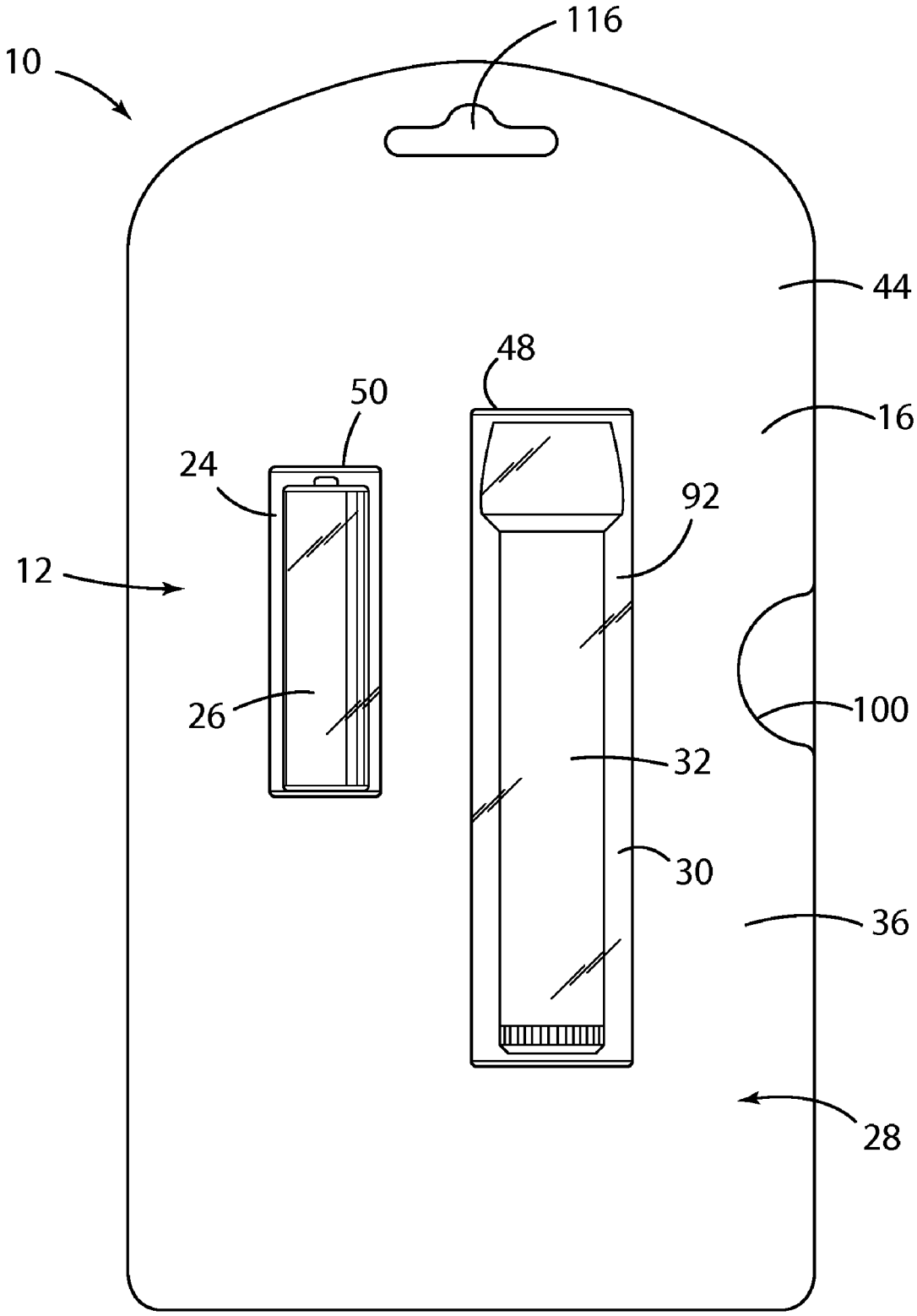
FIG. 1 is a front view of a package of a first embodiment of the present invention in a closed position.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
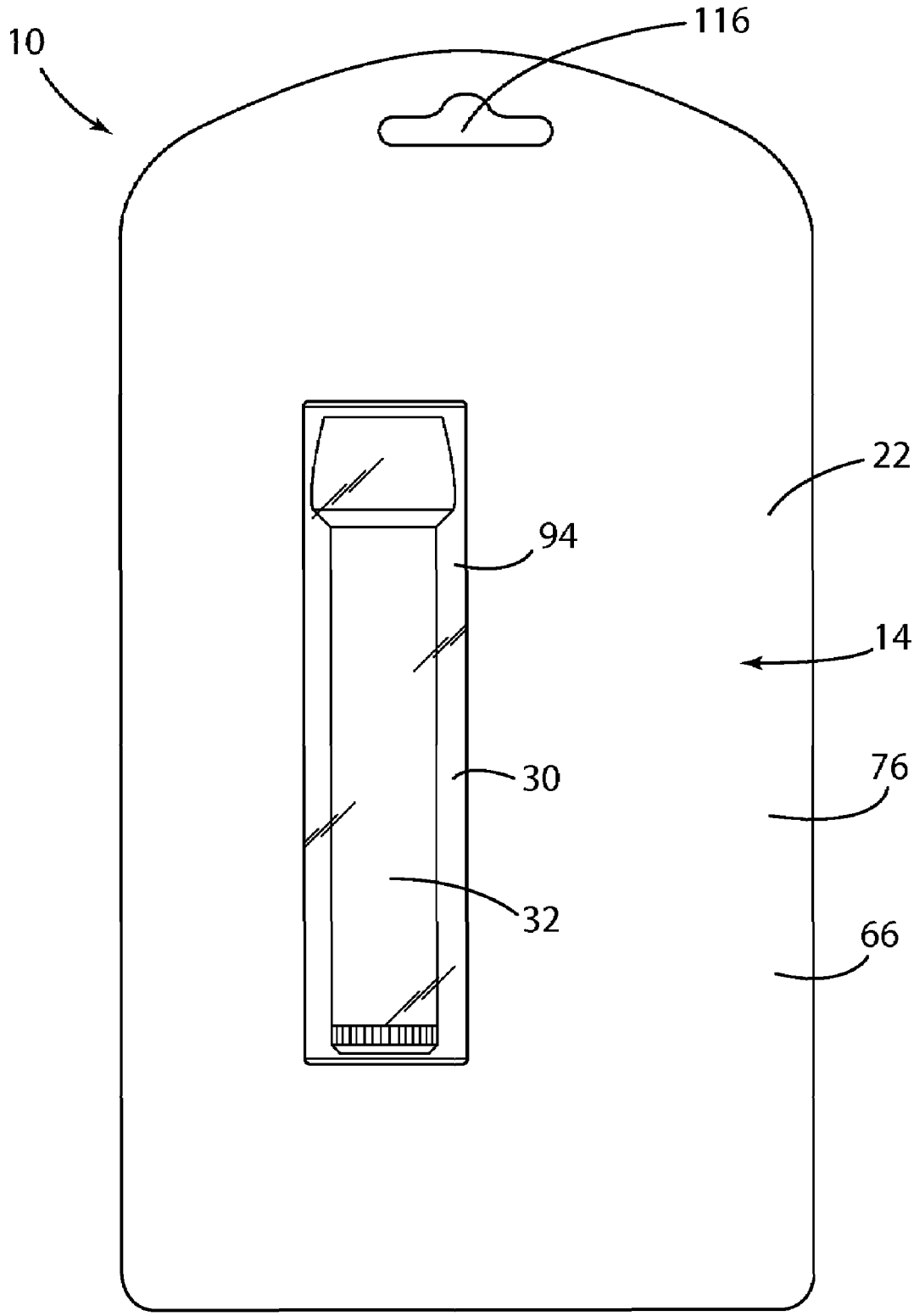
FIG. 2 is a rear view of the package of the first embodiment of the present invention in the closed position.

The reference number 10 (FIGS. 1-7) generally designates a package of the present invention. The package 10 comprises a first panel 12 and a second panel 14 pivotally connected to the first panel 12. The first panel 12 has a first front surface 16 and a first rear surface 18. The second panel 14 has a second front surface 20 and a second rear surface 22. The first panel 12 and the second panel 14 have a closed position (see FIGS. 1-3), wherein the first panel 12 abuts and overlies the second panel 14 such that the first rear surface 18 of the first panel 12 abuts the second front surface 20 of the second panel 14. The first panel 12 and the second panel 14 have an open position (FIG. 6), wherein the first rear surface 18 of the first panel 12 is spaced from the second front surface 20 of the second panel 14. The first panel 12 has an at least partially transparent battery holder 24. The battery holder 24 is configured to retain at least one battery 26 therein. The battery holder 24 is configured to allow the at least one battery 26 to be seen from a front 28 of the package 10 when the first panel 12 and the second panel 14 are in the closed position. The second panel 14 has an at least partially transparent light device holder 30. The light device holder 30 is configured to retain a light device 32 therein. The light device holder 30 is configured to allow the light device 32 to be seen from the front 28 of the package 10 when the first panel 12 and the second panel 14 are in the closed position. The light device holder 30 further is configured to allow the light device 32 to be seen from a front of the second panel 14 when the first panel 12 and the second panel 14 are in the open position.

In the illustrated example, the first panel 12 is connected to the second panel 14 and the package 10 is configured to be moved from the open position to the closed position (and any position therebetween). The first panel 12 can include a first section 34 and a second section 36 connected to the first section 34. The first section 34 and the second section 36 can be formed from one sheet 39, with a score line 38 through the one sheet 39, thereby forming the first section 34 and the second section 36. The one sheet 39 is then folded over so that a first side 40 of the first section 34 can abut a first side 42 of the second section 36 (see FIG. 4). The first section 34 and the second section 36 can thereafter be connected (e.g., by an adhesive or tape). The connected first section 34 and the second section 36 form the first panel 12, with a second side 44 of the second section 36 forming the first front surface 16 and a second side 46 of the first section 34 forming the first rear surface 18 (when the first panel 12 and the second panel 14 are in the closed position). It is further contemplated that the first section 34 and the second section 36 of the first panel 12 could be separate sheets laid on top of each other and connected (e.g., by an adhesive or tape). Furthermore, it is contemplated that the first panel 12 could only include one sheet.

It is further contemplated that the first section 34 and the second section 36 could be separate sheets and be pivotally connected by tape or other similar means. The first panel 12 (and the first section 34 and the second section 36) could be made from any material (e.g., cardboard, plastic, etc.). Moreover, it is contemplated that the first panel 12 (and the first section 34 and the second section 36) could have any peripheral shape. Additionally, it is contemplated that the first section 34 and the second section 36 could have the same peripheral shape or different peripheral shapes.

Figures 3, 4:
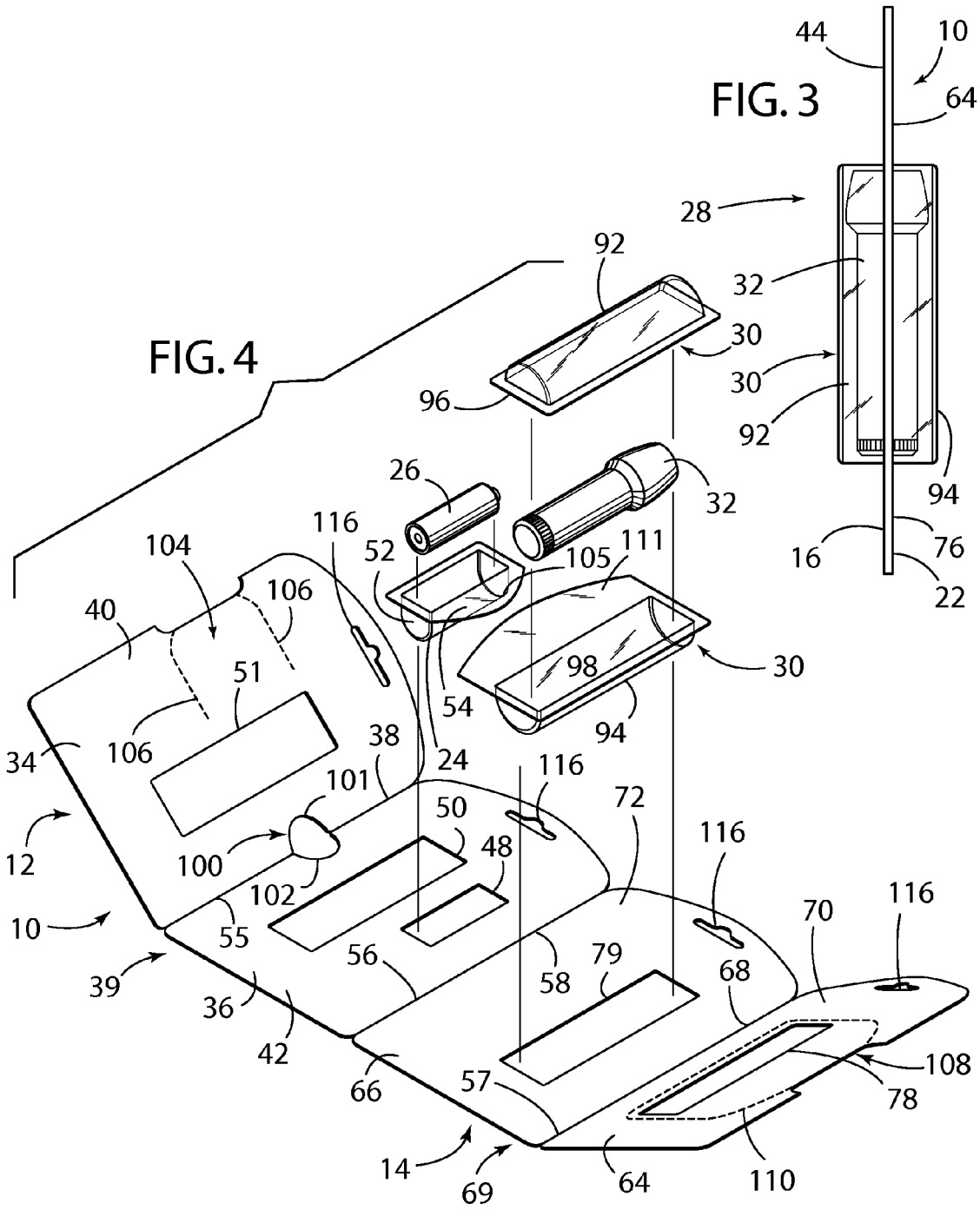
FIG. 3 is a side view of the package of the first embodiment of the present invention in the closed position.
FIG. 4 is an exploded perspective view of the package of the first embodiment of the present invention.
Figure 6:
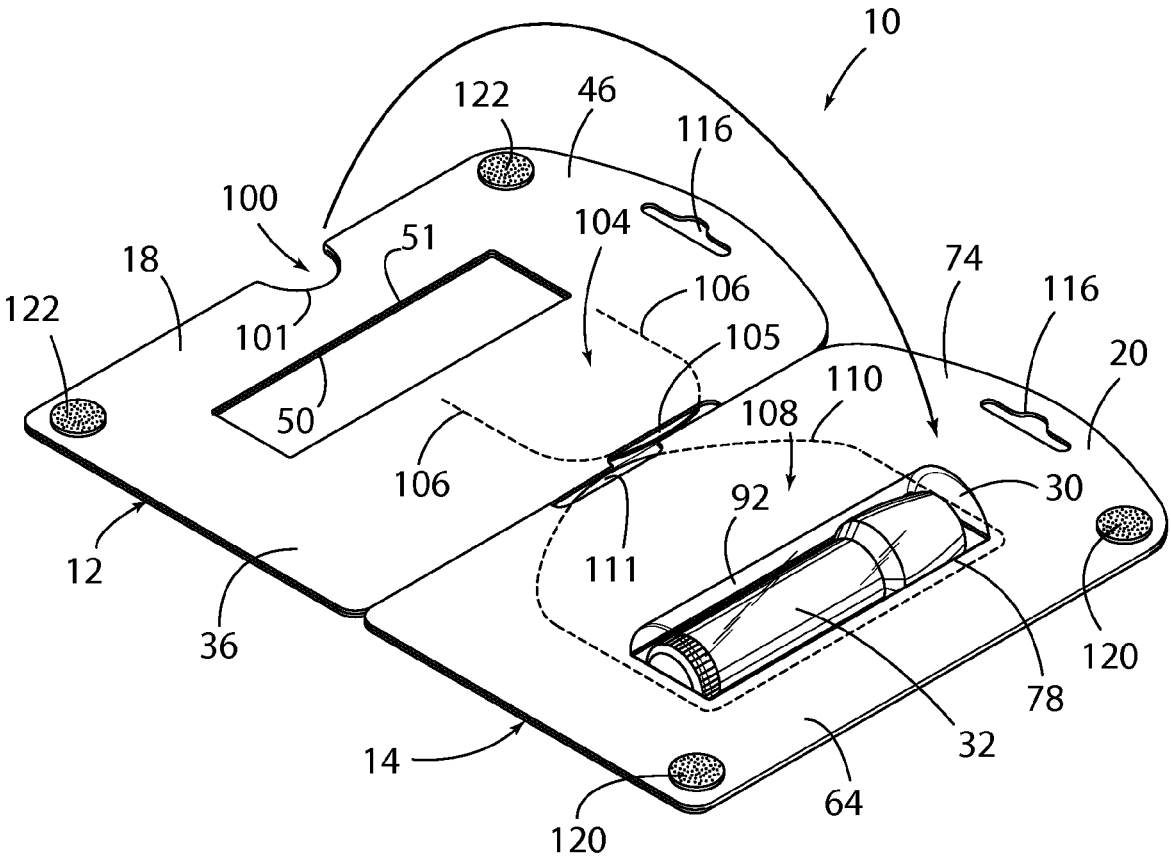
FIG. 6 is a perspective view of the package of the first embodiment of the present invention in an opened position.
Figure 7:
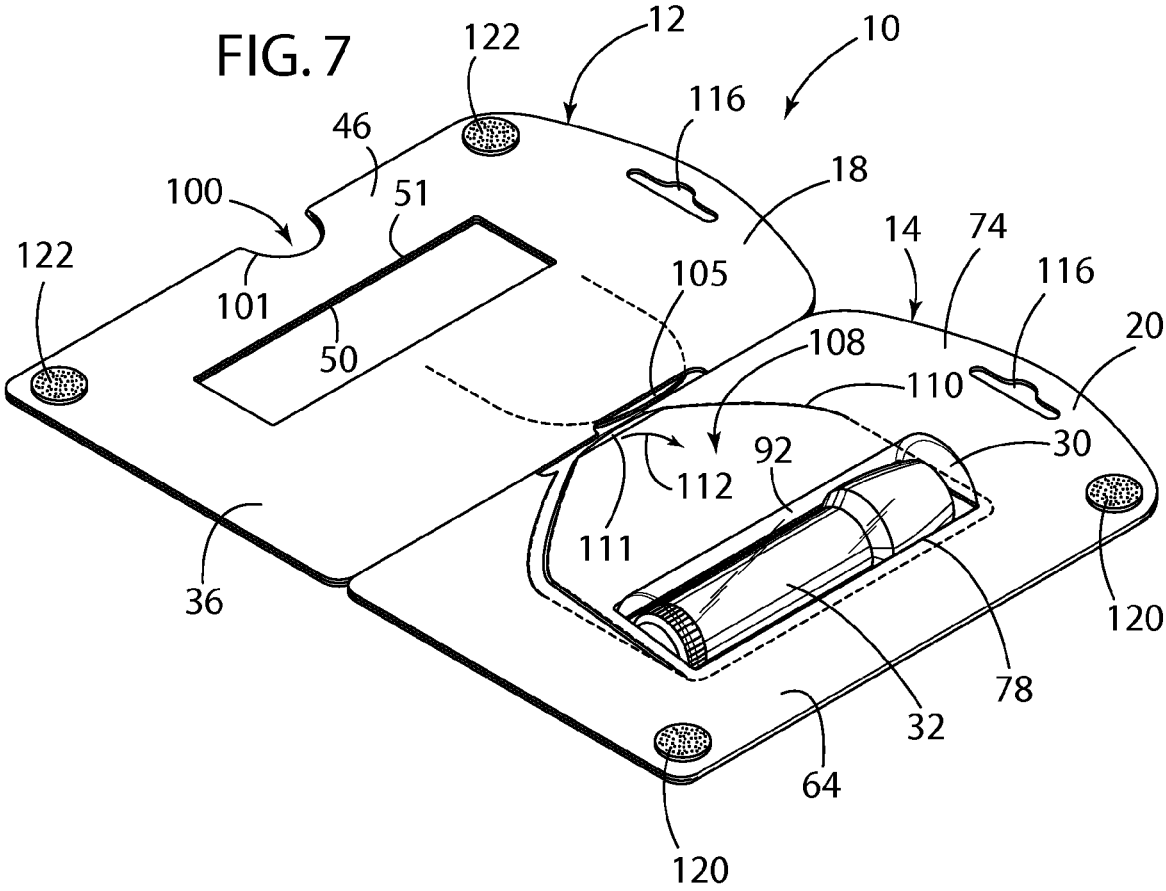
FIG. 7 is a perspective view of the package of the first embodiment of the present invention showing access to a light device.

The illustrated first panel 12 is configured to hold the at least one battery 26 and to allow the light device 32 to be seen from the front of the first panel 12 when the first panel 12 and the second panel 14 are in the open position. As illustrated in FIG. 4, the second section 36 of the first panel 12 includes a battery opening 48 and a first light device opening 50. The battery opening 48 can be substantially the shape of a periphery of the at least one battery 26, can be rectangular, or can be any other shape allowing the at least one battery 26 or a portion thereof to pass therethrough. The first light device opening 50 can conform to the shape of a periphery of the light device 32, can be rectangular, or can be any other shape allowing the light device 32 or a portion thereof to pass therethrough. The first section 34 of the first panel 12 also includes a second light device opening 51. The second light device opening 51 can conform to the shape of a periphery of the light device 32, can be rectangular, or can be any other shape allowing the light device 32 or a portion thereof to pass therethrough. As illustrated in FIG. 6, the first light device opening 50 and the second light device opening 51 can have a substantially similar periphery and are aligned once the first section 34 of the first panel 12 is connected to the second section 36 of the first panel 12.

Figure 5:
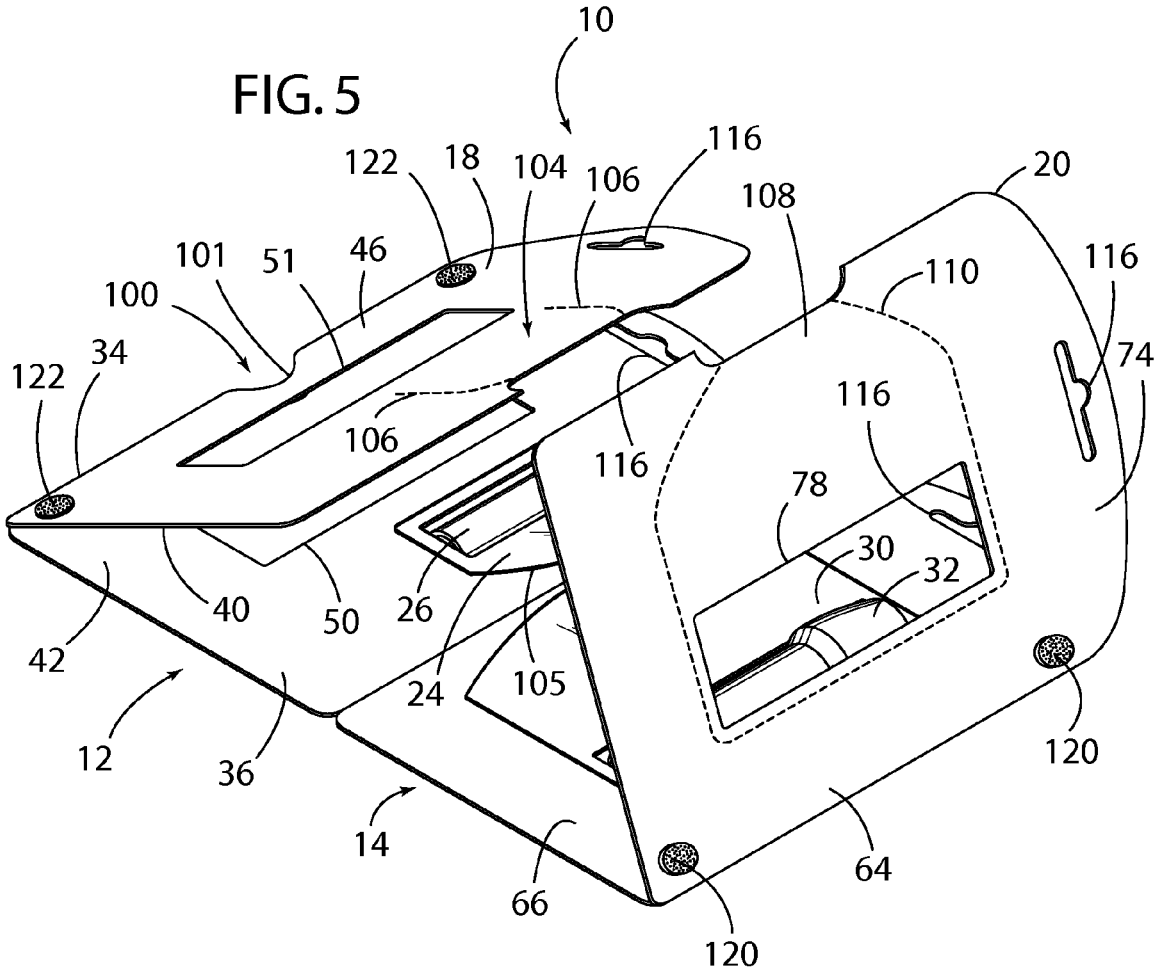
FIG. 5 is a perspective view of the package of the first embodiment of the present invention in a partially assembled configuration.

In the illustrated example, the at least partially transparent battery holder 24 is connected to the first panel 12 and comprises a transparent blister pack for displaying the at least one battery 26. The battery holder 24 includes a pocket portion 52 substantially conforming to the shape of the at least one battery 26. The battery holder 24 also includes a planar lip 54 extending from a periphery of the pocket portion 52. The battery holder 24 is connected to the first panel 12 by inserting the pocket portion 52 through the battery opening 48 in the second section 36 of the first panel 12 from the first side 42 of the second section 36 before the first section 34 of the first panel 12 is connected to the second section 36 of the first panel 12. Therefore, the lip 54 will be flush against the first side 42 of the second section 36 as illustrated in FIG. 5. Consequently, when the first section 34 of the first panel 12 is connected to the second section 36 of the first panel 12, the lip 54 will be captured between the first section 34 and the second section 36 of the first panel 12. Furthermore, the pocket portion 52 extends from the second side 44 of the second section 36 of the first panel 12 and can be seen from the front 28 of the package 10 when the first panel 12 and the second panel 14 are in the closed position (see FIG. 1). The lip 54 can be adhered to the first side 42 of the second section 36, adhered to the first side 40 of the first section 34 and/or captured and held in place between the first section 34 and the second section 36 of the first panel 12 without being adhered to the either or both of the first section 34 or the second section 36 of the first panel 12.

The illustrated at least one battery 26 is held by the first panel 12 in the illustrated embodiment. The at least one battery 26 can include any number of batteries 26 comprising electrochemical cells for supplying voltage to the light device 32. The at least one battery 26 can comprise any of the popular alkaline or lithium cells of the generally cylindrical shape are commercially available in industry-recognized, standard sizes, including D-, C-, AA-, AAA-, and AAAA-size cells, as well as other sizes and configurations. Alternatively, disc-shaped batteries commercially available for small electrically operated devices, such as hearing aids, could be used.

In the illustrated example, the at least one battery 26 comprises one cylindrical battery 26 captured within the first panel 12. As illustrated in FIGS. 5 and 6, the battery 26 is held between the pocket portion 52 of the battery holder 24 and the first section 34 of the first panel 12. However, if the first panel 12 only includes one sheet as described above, the lip 54 of the battery holder 24 could be directly connected to the first front surface 16 of the first panel 12 (and thereby extend through the battery opening 48 in the first panel 12 and include a backing for the battery holder 24) or the lip 54 could be directly connected to the first rear surface 18 of the first panel 12.

The illustrated second panel 14 is connected to the first panel 12 and is configured to be moved from the open position to the closed position. The second panel 14 can include a first section 64 and a second section 66 connected to the first section 64. The first section 64 and the second section 66 can be formed from one sheet 69, with a score line 68 through the one sheet 69, thereby forming the first section 64 and the second section 66. The one sheet 69 is then folded over so that a first side 70 of the first section 64 can abut a first side 72 of the second section 66 (see FIG. 5). The first section 64 and the second section 66 can thereafter be connected (e.g., by an adhesive or tape). The connected first section 64 and the second section 66 form the second panel 14, with a second side 74 of the first section 64 forming the second front surface 20 and a second side 76 of the second section 66 forming the second rear surface 22. It is further contemplated that the first section 64 and the second section 66 of the second panel 14 could be separate sheets laid on top of each other and connected (e.g., by an adhesive or tape). Furthermore, it is contemplated that the second panel 14 could only include one sheet.

It is further contemplated that the first section 64 and the second section 66 could be separate sheets and be pivotally connected by tape or other similar means. The second panel 14 (and the first section 64 and the second section 66) could be made from any material (e.g., cardboard, plastic, etc.). Moreover, it is contemplated that the second panel 14 (and the first section 64 and the second section 66) could have any peripheral shape. Additionally, it is contemplated that the first section 64 and the second section 66 could have the same peripheral shape or different peripheral shapes.

In the illustrated embodiment, the first panel 12 is pivotally connected to the second panel 14. As illustrated in FIGS. 4 and 5, the second section 36 of the first panel 12 is connected to the second section 66 of the second panel 14. As illustrated, the second section 36 of the first panel 12 is connected to the first section 34 of the first panel 12 at a first edge 55 and the second section 36 of the first panel 12 is connected to the second section 66 of the second panel 14 at a second edge 56, with the first edge 55 being opposite to the second edge 56. However, it is contemplated that the first edge 55 and the second edge 56 could be any of the edges of the second section 36 of the first panel 12. Furthermore, it is contemplated that the first section 34 of the first panel 12 could be connected to the second panel 14. Likewise, as illustrated in FIGS. 4 and 5, the second section 66 of the second panel 14 is connected to the first section 64 of the second panel 14 at a first edge 57 and the second section 66 of the second panel 14 is connected to the second section 36 of the first panel 12 at a second edge 58, with the first edge 57 being opposite to the second edge 58. However, it is contemplated that the first edge 57 and the second edge 58 could be any of the edges of the second section 66 of the second panel 14. Furthermore, it is contemplated that the first section 64 of the second panel 14 could be connected to the first panel 12.

The illustrated first panel 12 and second panel 14 of the package 10 could be formed and connected in many manners. For example, the first panel 12 and the second panel 14 could initially comprise a single sheet, with a score line defining a transition between the first panel 12 and the second panel 14, between the second section 36 of the first panel 12 and the second section 66 of the second panel 14, or between the first section 34 of the first panel 12, the second section 36 of the first panel 12, the first section 64 of the second panel 14 and the second section 66 of the second panel 14. Furthermore, the first panel 12 and the second panel 14 could comprise a sheet of material with a score line defining a transition between the second section 36 of the first panel 12 and the second section 66 of the second panel 14, with the first section 34 of the first panel 12 being adhered to the second section 36 of the first panel 12 and the first section 64 of the second panel 14 being adhered to the second section 66 of the second panel 14. Moreover, it is contemplated that the first panel 12 and the second panel 14 could comprise a single sheet of plastic, paper or cardboard (or any other material that will allow folding) having two to four sheets of stiff or semi-stiff material (e.g., cardboard or plastic) adhered thereto defining the first section 34 of the first panel 12, the second section 36 of the first panel 12, the first section 64 of the second panel 14 and the second section 66 of the second panel 14.

The illustrated second panel 14 is configured to hold the light device 32 and to allow the light device 32 to be seen from the front of the first panel 12 when the first panel 12 and the second panel 14 are in the open position and the closed position. As illustrated in FIG. 4, the first section 64 of the second panel 14 includes a first light device opening 78 and the second section 66 of the second panel 14 includes a second light device opening 79. The first light device opening 78 and the second light device opening 79 can conform to the shape of a periphery of the light device 32, can be rectangular, or can be any other shape allowing the light device 32 or a portion thereof to pass therethrough. As illustrated in FIG. 4, the first light device opening 78 and the second light device opening 79 of the second panel 14 and the first light device opening 50 and the second light device opening 51 of the first panel 12 can have a substantially similar periphery and are aligned once the second section 36 of the first panel 12 is connected to the second section 66 of the second panel 12 and the first panel 12 and the second panel 14 are in the closed position.

In the illustrated example, the at least partially transparent light device holder 30 is connected to the second panel 14 and comprises a transparent blister pack for displaying the light device 32. The light device holder 30 includes a front pocket portion 92 and a rear pocket portion 94 substantially conforming to the shape of the light device 32. The front pocket portion 92 and the rear pocket portion 94 are configured to capture the light device 32 therebetween. The front pocket portion 92 includes a planar lip 96 extending from a periphery of the front pocket portion 92. Likewise, rear pocket portion 94 includes a planar lip 98 extending from a periphery of the rear pocket portion 94. The light device holder 30 is connected to the second panel 14 by inserting the rear pocket portion 94 through the second light device opening 79 in the second section 66 of the second panel 14 from the first side 72 of the second section 66 before the first section 64 of the second panel 14 is connected to the second section 66 of the second panel 14. Therefore, the lip 98 will be flush against the first side 72 of the second section 66 as illustrated in FIG. 5. Furthermore, the light device holder 30 is connected to the second panel 14 by inserting the front pocket portion 92 through the first light device opening 78 in the first section 64 of the second panel 14 from the first side 70 of the first section 64 before the first section 64 of the second panel 14 is connected to the second section 66 of the second panel 14. Therefore, the lip 96 will be flush against the first side 70 of the first section 64 as illustrated in FIG. 5.

Consequently, in the illustrated embodiment, when the first section 64 of the second panel 14 is connected to the second section 66 of the second panel 14, the lip 96 and the lip 98 will be captured between the first section 64 and the second section 66 of the second panel 14. Furthermore, the front pocket portion 92 extends from the second side 74 of the first section 64 of the second panel 14 and will also extend through the first light device opening 50 and the second light device opening 51 of the first panel 12 to be seen from the front 28 of the package 10 when the first panel 12 and the second panel 14 are in the closed position. Moreover, the rear pocket portion 94 extends from the second side 76 of the second section 66 of the second panel 14 to be seen from a rear of the package 10 when the first panel 12 and the second panel 14 are in the closed position. The lip 96 and the lip 98 can be adhered to the first side 42 of the second section 66, adhered to the first side of the first section 64 and/or captured and held in place between the first section 64 and the second section 66 of the second panel 14 without being adhered to the either or both of the first section 64 or the second section 66 of the second panel 14.

The illustrated light device 32 is held by the second panel 14 in the illustrated embodiment. The light device 32 can include any device for projecting light (e.g., flashlight) having any number of light producing means (e.g., LED, incandescent bulb, etc.). In the illustrated example, the light device 32 is held between the front pocket portion 92 and the rear pocket portion 94 of the light device holder 30 of the second panel 14. However, if the second panel 14 only includes one sheet as described above, the lip 96 and the lip 98 of the light device holder 30 could be directly connected to the second front surface 20 or the second rear surface 22 of the second panel 14.

In the illustrated embodiment, the package 10 includes a finger notch 100 for easily moving the first panel 12 and the second panel 14 to the open position. As illustrated in FIG. 4, the first section 34 of the first panel 12 includes a first indentation 101 adjacent the second section 36 of the first panel 12 and the second section 36 of the first panel 12 includes a second indentation 102 at the first edge 55 thereof and adjacent the first section 34. The first indentation 101 and the second indentation 102 overlap and easily allow a user of the package 10 to grasp the first panel 12 to open the first panel 12 relative to the second panel 14 (e.g., by grasping the second panel 14 with one hand and grasping the first panel 12 along one or two of its edges with the other hand for opening). The first indentation 101 and the second indentation 102 could be curved (as shown), rectangular or could include any configuration. Furthermore, it is contemplated that the finger notch 100 could be located in a middle area of the first panel 12 instead of at an edge of the first panel 12.

The illustrated package 10 further includes a releasable connector for selectively keeping the first panel 12 and the second panel 14 in the closed position. As illustrated in FIG. 6, the first section 34 of the first panel 12 includes a first pair of outer releasable sealing devices 122 on the second side 46 of the first section 34 of the first panel 12 and the second panel 14 includes a second pair of outer releasable sealing devices 120 on the second side 74 of the first section 64 of the second panel 14. The first pair of outer releasable sealing devices 122 and the second pair of outer releasable sealing devices 120 are configured to be connected to releasably seal the first panel 12 and the second panel 14 in the closed position. The first pair of outer releasable sealing devices 122 and the second pair of outer releasable sealing devices 120 could comprise any releasable connector. For example, the first pair of outer releasable sealing devices 122 and the second pair of outer releasable sealing devices 120 could comprise a hook-and-loop type fastener, a pressure sensitive adhesive, magnets (or magnets and metal), or a mechanical fastener (e.g., button or snap). Furthermore, it is contemplated that only one outer releasable sealing device 122 and/or one outer releasable sealing device 120 could be used.

In the illustrated example, the package 10 includes a horizontal, substantially oval aperture 116 for hanging the battery package 10 on a rod (not shown) in a store for displaying the package 10. The aperture 116 extends through the first section 34 and the second section 36 of the first panel 12 and the first section 64 and the second section 66 of the second panel 14. The aperture 116 also preferably includes a centrally located enlarged, circular portion for locating the rod about the center of gravity of the package 10.

The illustrated package 10 includes easy opening features for allowing the at least one battery 26 and the light device 32 to be easily removed from the rest of the package 10. As illustrated in FIGS. 4-7, the first panel 12 includes a first tear away strip 104 to allow access to the at least one battery 26 when the first panel 12 and the second panel 14 are in the open position. The first tear away strip 104 in the illustrated embodiment is formed as part of the first section 34 of the first panel 12 and includes a pair of perforations 106 in the first section 34 of the first panel 12. The pair of perforations 106 extend to the outer edge of the first section 34 of the first panel 12. The first tear away strip 104 also includes a first pull tab 105 (part of the lip 54 of the battery holder 24) (see FIGS. 4, 6 and 7) located under and between the pair of perforations 106 and below the first section 34 of the first panel 12. In order to easily access the at least one battery 26, a user of the package 10 can pull the first tear away strip 104 by the first pull tab 105, thereby separating the first tear away strip 104 from the rest of the first panel 12 down the pair of perforations 106 along with pulling the battery holder 24 away from the rest of the first panel 12. In the illustrated embodiment, since the at least one battery 26 is captured between the first tear away strip 104 and the pocket portion 52 of the battery holder 24, once the first tear away strip 104 is removed, the battery holder 24 can fall away free (if not connected to the first section 34 or the second section 36 of the first panel) and the at least one battery 26 can be easily removed from the battery holder 24. It is further contemplated that the first tear away strip 104 could only include material from the first section 34 of the first panel 12 (and not any portion of the battery holder 24 and therefore not including the first pull away tab 105) such that the battery 26 will be accessible once the first tear away strip is removed.

In the illustrated embodiment, the package 10 also includes a second tear away strip 108 for allowing the light device 32 to be easily removed from the rest of the package 10. As illustrated in FIGS. 4-7, the second panel 14 includes the first tear away strip 108 to allow access to the light device 32 when the first panel 12 and the second panel 14 are in the open position. The second tear away strip 108 in the illustrated embodiment is formed as part of the first section 64 of the second panel 14 and includes a perforation 110 surrounding the first light device opening 78 in the first section 64 of the second panel 14. The perforation 110 extends to the outer edge of the first section 64 of the second panel 14. The second tear away strip 108 also includes a second pull tab 111 (part of the lip 98 of the light device holder 30) (see FIGS. 4, 6 and 7) located within and under the perforation 110 and below the first section 64 of the second panel 14. In order to easily access the light device 32, a user of the package 10 can pull the second tear away strip 108 by the second pull tab 111 along line 112, thereby separating the second tear away strip 108 from the rest of the second panel 14 along the perforation 110 along with pulling the light device holder 30 away from the rest of the second panel 14. In the illustrated embodiment, since the light device 32 is captured between the second tear away strip 108 and the rear pocket portion 98 of the light device holder 30, once the second tear away strip 108 is removed, the light device holder 30 can fall away free (if not connected to the first section 64 or the second section 66 of the second panel) and the light device 32 can be easily removed from the light device holder 30. It is contemplated that the lip 96 and the front pocket portion 92 could be connected (e.g., by an adhesive) to the second tear away strip 108 such that the lip 96 and the front pocket portion 92 will pull away from the rest of the second panel 14 when the second tear away strip 108 is pulled away from the rest of the second panel 14. It is contemplated that the second tear away strip 108 could be configured to be completely removed from the rest of the second panel 14 or could include a portion that remains connected to the rest of the second panel 14 when the perforation 110 (or perforations 110) are fully torn. It is further contemplated that the second tear away strip 108 could only include material from the first section 64 of the second panel 14 (and not any portion of the light device holder 30 and therefore not including the second pull away tab 111) such that the light device 32 will be accessible once the second tear away strip is removed. Furthermore, it is contemplated the second pull tab 111 could be included on the lip 96 adjacent the front pocket portion 92 of the light device holder 30 such that the front pocket portion 92 will be pulled along with the second tear away strip 108 and leave the light device 32 and the rear pocket portion 98 remaining in the second section 64 of the second panel 14.

Figure 8:
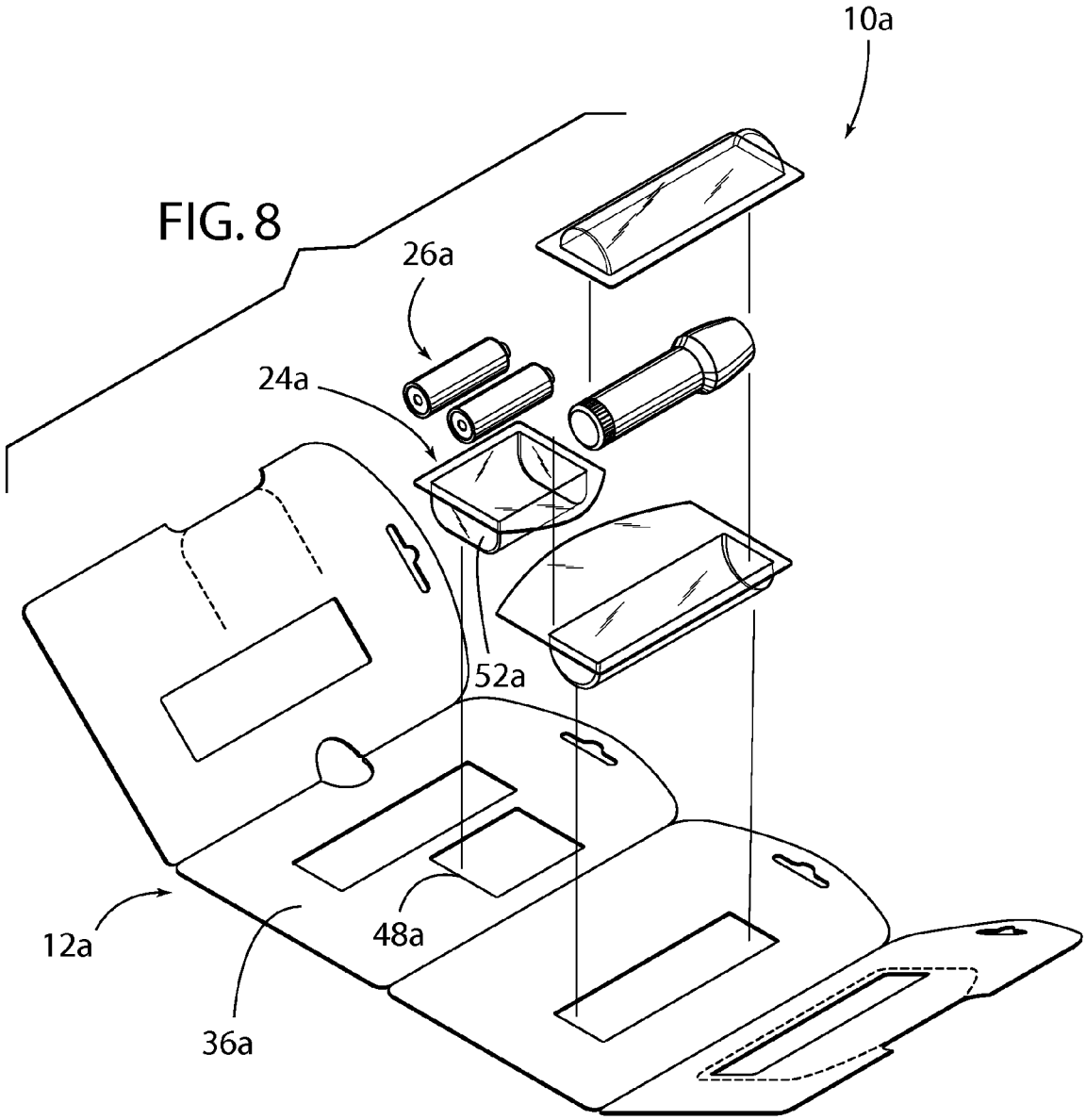
FIG. 8 is an exploded perspective view of a package of a second embodiment of the present invention.
Figure 9:
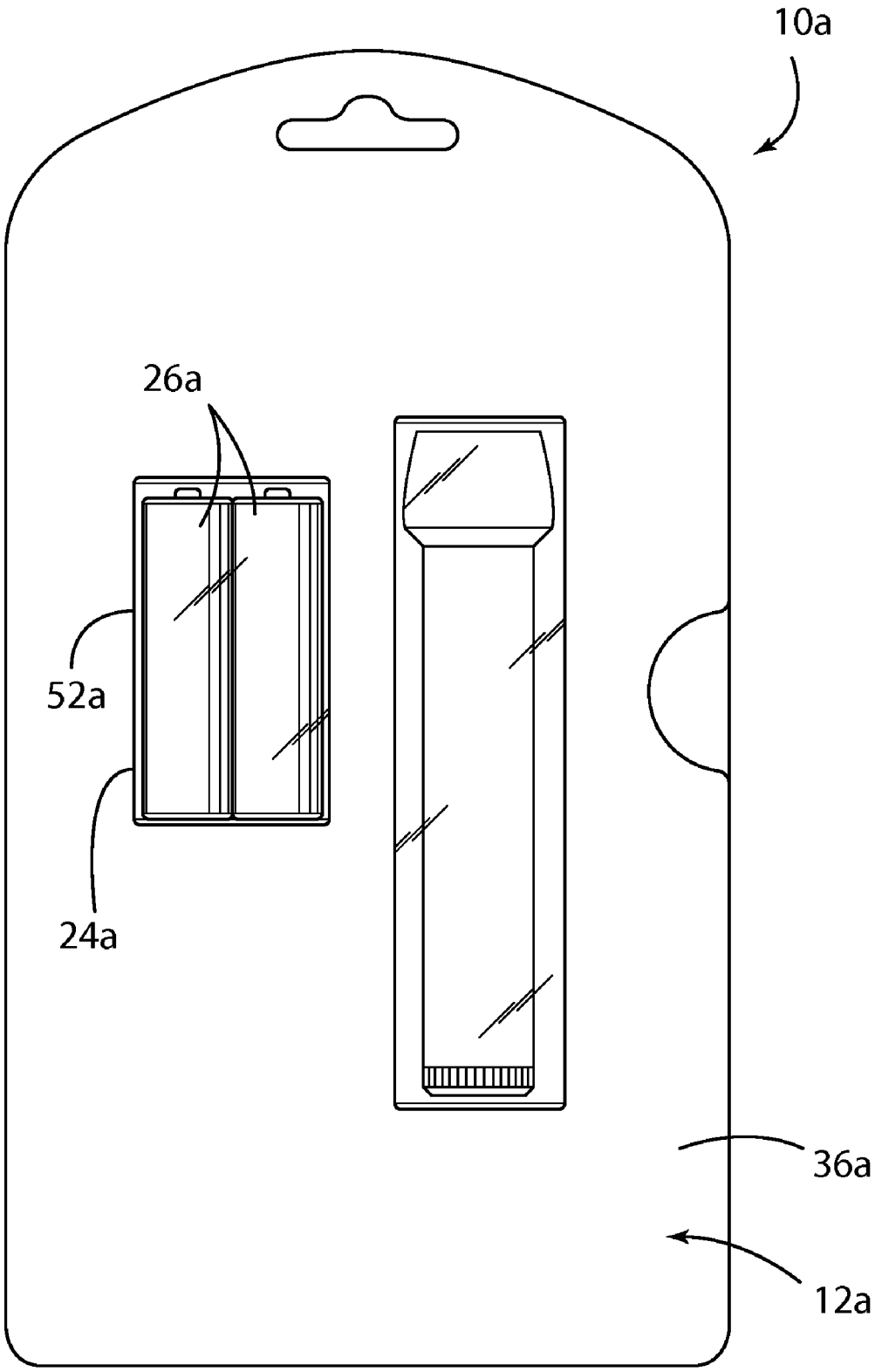
FIG. 9 is a front view of the package of the second embodiment of the present invention in the closed position.

The reference numeral 10*a* (FIGS. 8-9) generally designates another embodiment of the present invention, having a second embodiment for the package. Since package 10*a* is similar to the previously described package 10, similar parts appearing in FIGS. 1-7 and FIGS. 8-9, respectively, are represented by the same, corresponding reference number, except for the suffix "a" in the numerals of the latter. The second embodiment of the package 10*a* is substantially similar to the first embodiment of the package 10, except that the at least one battery 26*a* comprises two batteries 26*a* and the battery holder 24*a* is configured to hold two batteries 26*a*. Furthermore, the pocket portion 52*a* of the battery holder 24*a* is larger to accommodate the two batteries 26*a*. Likewise, the battery opening 48*a* in the second section 36*a* of the first panel 12*a* is larger to accommodate the two batteries 26*a*.

Figure 10:
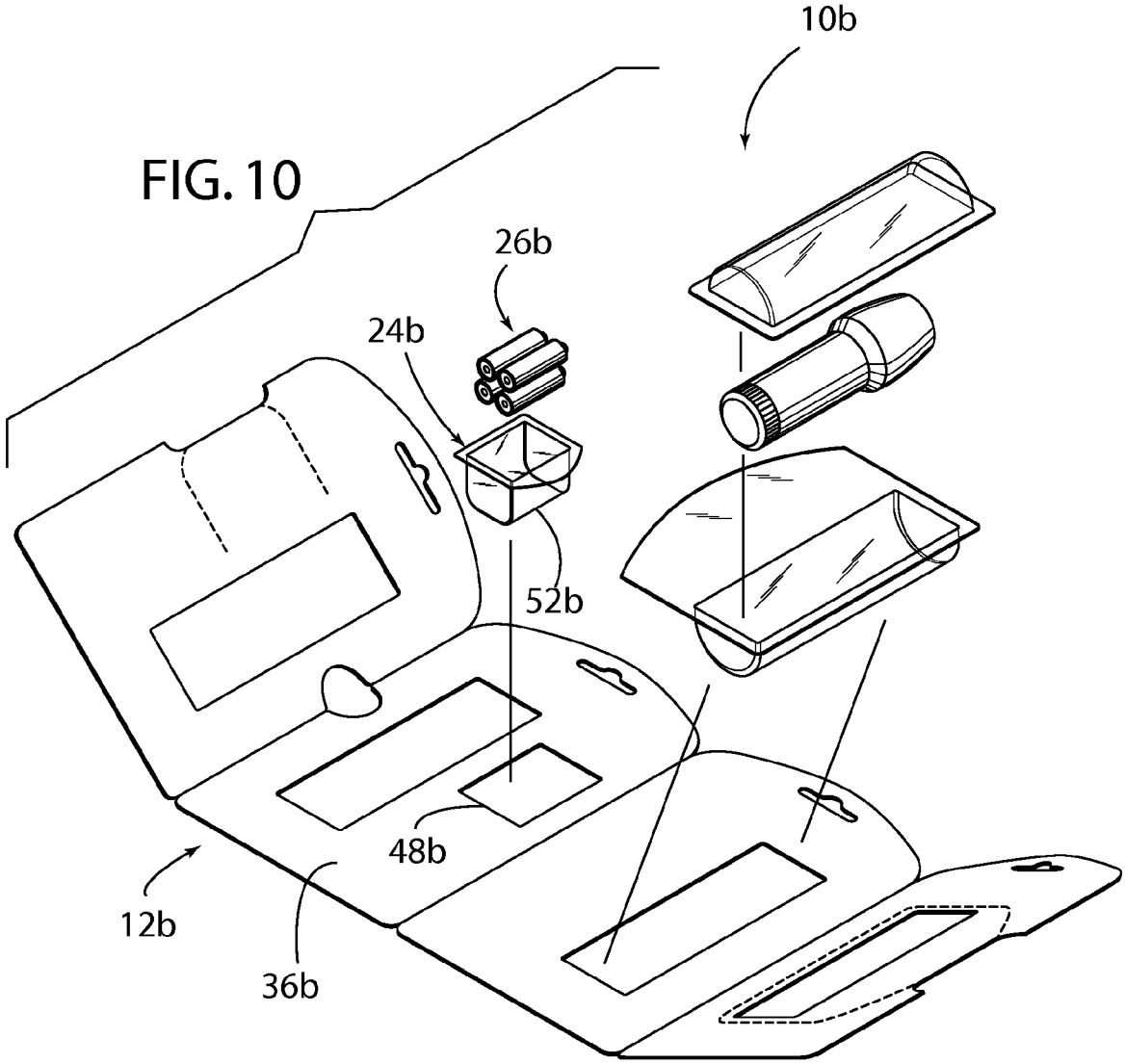
FIG. 10 is an exploded perspective view of a package of a third embodiment of the present invention.
Figure 11:
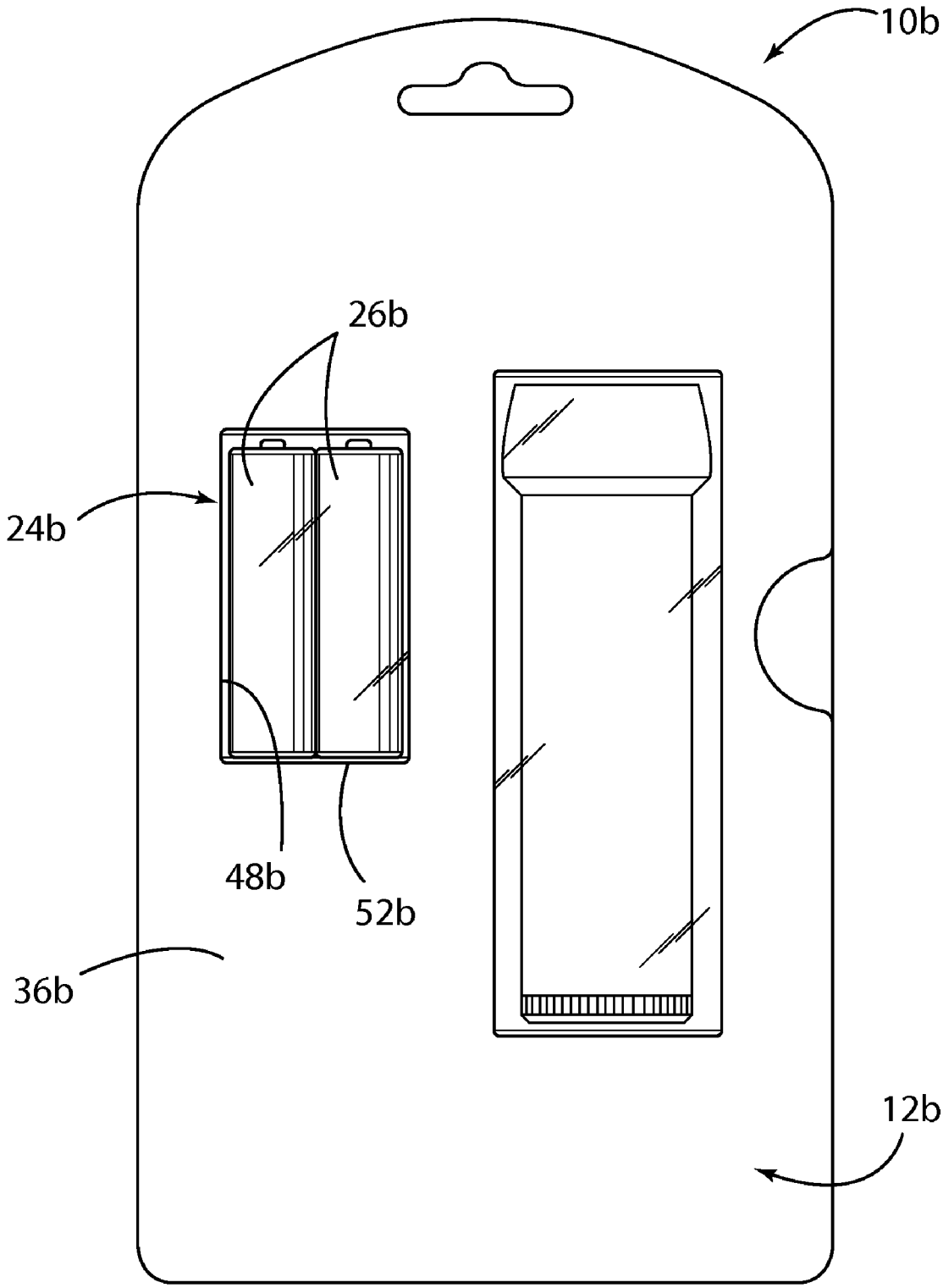
FIG. 11 is a front view of the package of the third embodiment of the present invention in the closed position.

The reference numeral 10*b* (FIGS. 10-11) generally designates another embodiment of the present invention, having a third embodiment for the package. Since package 10*b* is similar to the previously described package 10, similar parts appearing in FIGS. 1-7 and FIGS. 10-11, respectively, are represented by the same, corresponding reference number, except for the suffix "b" in the numerals of the latter. The third embodiment of the package 10*b* is substantially similar to the first embodiment of the package 10, except that the at least one battery 26*b* comprises four batteries 26*b* and the battery holder 24*b* is configured to hold four batteries 26*b*. Furthermore, the pocket portion 52*b* of the battery holder 24*b* is larger to accommodate the four batteries 26*b*. Likewise, the battery opening 48*b* in the second section 36*b* of the first panel 12*b* is larger to accommodate the two batteries 26*b*.

The reference numeral 10*c* (FIGS. 12-15) generally designates another embodiment of the present invention, having a fourth embodiment for the package. Since package 10*c* is similar to the previously described package 10, similar parts appearing in FIGS. 1-7 and FIGS. 12-15, respectively, are represented by the same, corresponding reference number, except for the suffix "c" in the numerals of the latter. The fourth embodiment of the package 10C is substantially similar to the first embodiment of the package 10, except that the at least one battery 26*c* comprises two groups of batteries and the light device 32*c* comprises a head lamp.

In the illustrated example, the light device 32*c* comprises a head lamp configured to be worn on a head of a user. The light device 32*c* includes a lamp portion 32*c*' having a bezel portion 208, a base portion 206 and a head strap/rear portion 204. The head strap/rear portion 204 includes a rear portion of the light device 32*c* and/or a strap for surrounding a head of a user of the light device 32*c*. The illustrated light device 32*c* also includes a first power pack 32*c*" and a second power pack 32*c*'". The first power pack 32*c*" is configured to hold a first type of battery (e.g., A-type cell battery) and the second power pack 32*c*'" is configured to hold a second type of battery (e.g., AA-type cell battery). Either the first power pack 32*c*" or the second power pack 32*c*'" can be used with the remainder of the light device 32*c* to power the light device 32*c*. Such a light device 32*c* is disclosed in commonly-assigned patent application Ser. No. 11/765,810 entitled Lighting Device Having Forward Directed Heat Sink Assembly (Filing date: Jun. 20, 2007; Inventor: David A. Spartano), the entire contents of which are hereby incorporated by reference.

Figure 12:
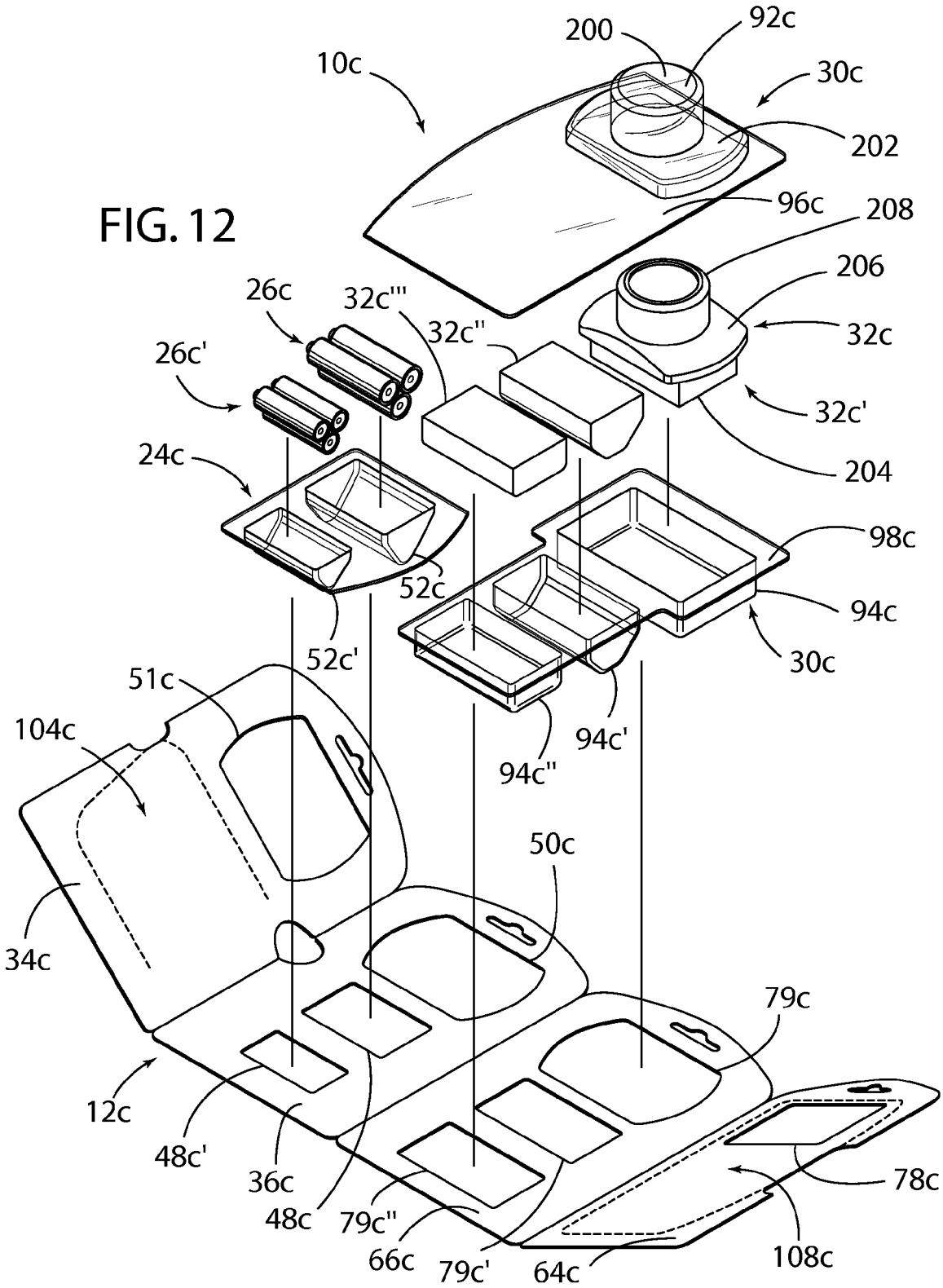
FIG. 12 is an exploded perspective view of a package of a fourth embodiment of the present invention.
Figure 13:
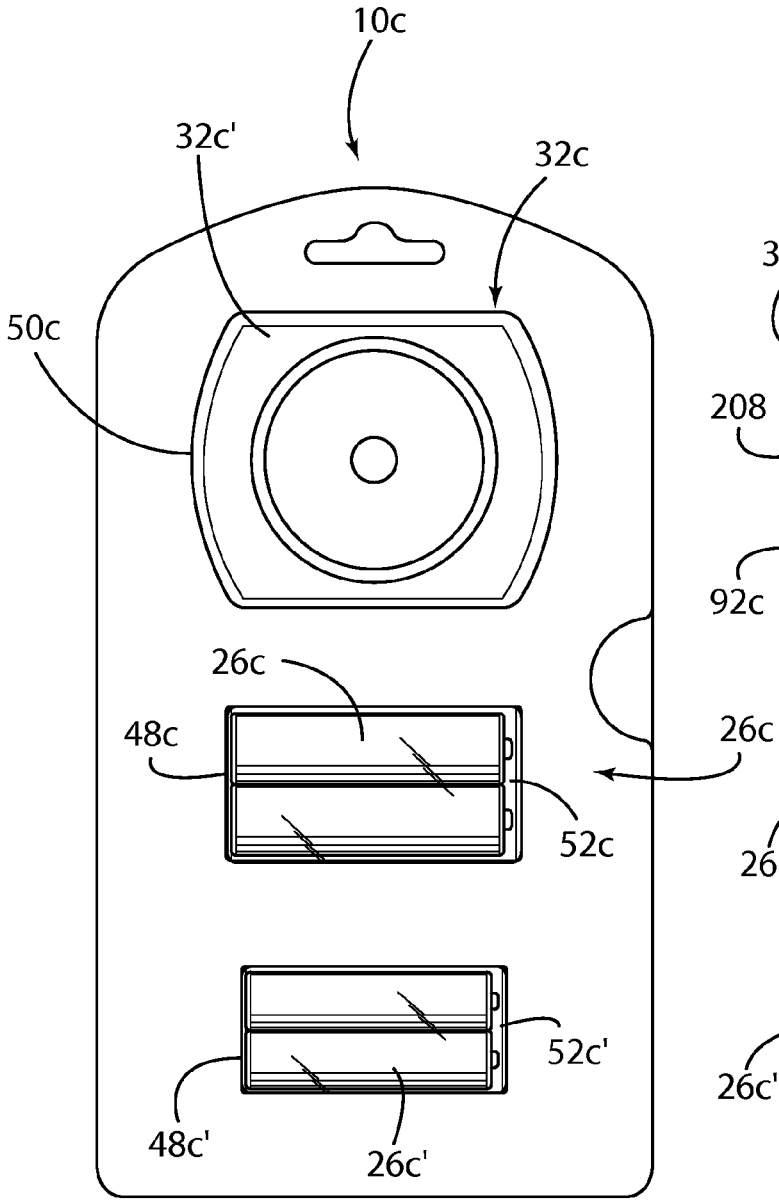
FIG. 13 is a front view of the package of the fourth embodiment of the present invention in the closed position.
Figure 14:
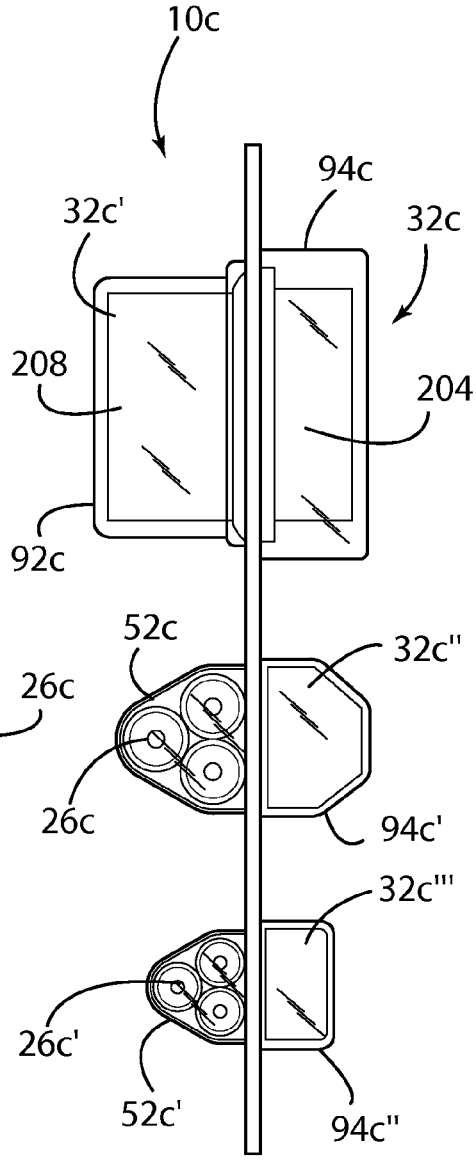
FIG. 14 is a side view of the package of the fourth embodiment of the present invention in the closed position.
Figure 15:
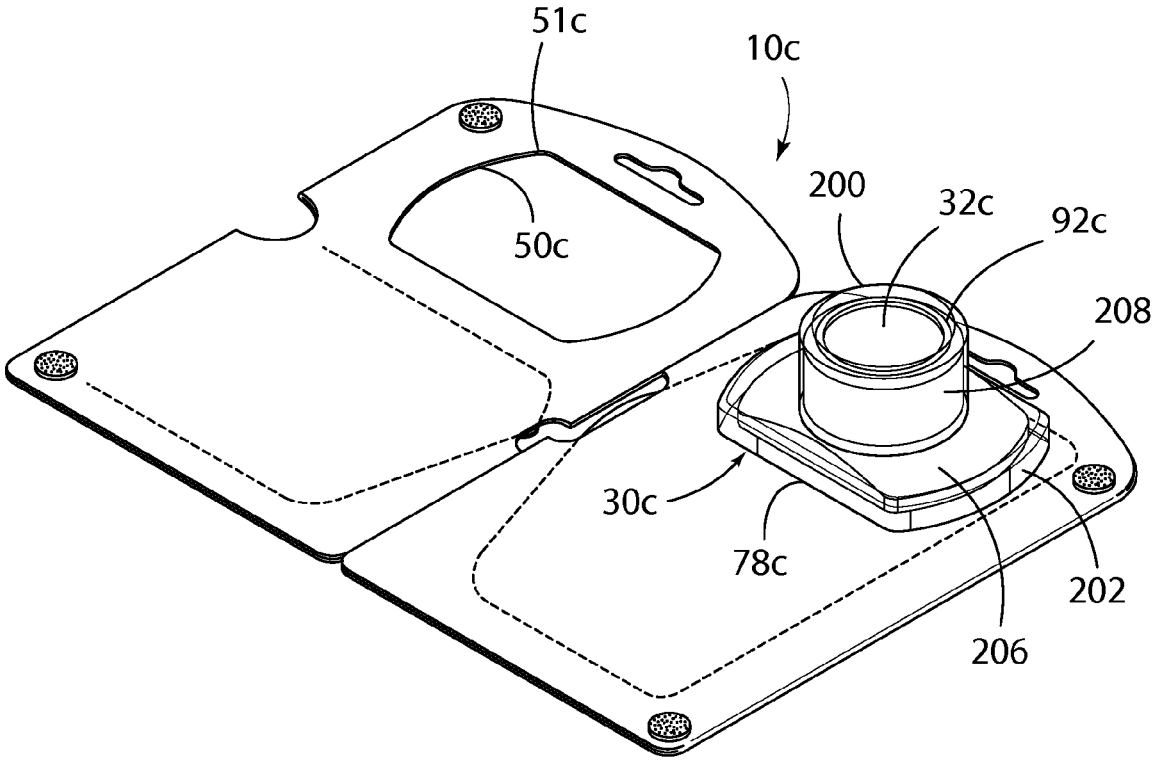
FIG. 15 is a perspective view of the package of the fourth embodiment of the present invention in the opened position.

The illustrated light device holder 30*c*, first panel 12*c* and second panel 14*c* of the fourth embodiment of the package 10*c* is different than the light device holder 30, the first panel 12 and the second panel 14 of the first embodiment of the package 10 in order to accommodate the light device 32*c* and the batteries 24*c*, 24*c*' of the third embodiment of the package 10*c*. The light device holder 30*c* includes a front pocket portion 92*c* having a bezel portion receiving area 200 and a base portion receiving area 202 for receiving the bezel portion 208 and the base portion 206 of the light device 32*c*, respectively. The front pocket portion 92*c* also includes an enlarged lip 96*c*. The light device holder 30*c* also includes a first rear pocket portion 94*c* for receiving the head strap/rear portion 204 of the light device 32*c*, a second rear pocket portion 94*c*' for receiving the first power pack 32*c*", and a third rear pocket portion 94*c*" for receiving the second power pack 32*c*'". The first section 64*c* of the second panel 14 includes a first light device opening 78*c* for accepting the front pocket portion 92*c* therethrough. The second section 66*c* of the second panel 14*c* includes a first portion of the light device opening 79*c* for accepting the first rear pocket portion 94*c*, a second portion of the light device opening 79c' for accepting the second rear pocket portion 94c' and a third portion of the light device opening 79c" for accepting the third rear pocket portion 94c". Once the first section 64c of the second panel 14c is connected to the second section 66c of the second panel 14c, the front pocket portion 92c of the light device holder 30c (with the bezel portion 208 and the base portion 206 of the light device 32c therein) will extend from the second front surface 20c and the first rear pocket portion 94c (with the head strap/rear portion 204 of the light device 32c therein), the second rear pocket portion 94c' (with the first power pack 32c" therein), and the third rear pocket portion 94c" (with the second power pack 32c'" therein) will extend from the second rear surface 22c. It is noted that the second tear away strip 108c is larger than the area occupied by the first rear pocket portion 94c, the second rear pocket portion 94c' and the third rear pocket portion 94c" as illustrated in FIG. 12.

In the illustrated example, the at least one battery comprises a first group of batteries 26c and a second group of batteries 26c for the first power pack 32c" and the second power pack 32c'" of the light device 32c, respectively. In the illustrated embodiment, both the first group of batteries 26c and the second group of batteries 26c' includes three batteries. However, the first group of batteries 26c and the second group of batteries 26c' could include any number of batteries. The illustrated battery holder 24c and first panel 12c of the fourth embodiment of the package 10c is different than the battery holder 24 of the first embodiment of the package 10 in order to accommodate the batteries 24c, 24c' of the third embodiment of the package 10c. The battery holder 24c includes a first pocket portion 52c for holding the first group of batteries 26c and a second pocket portion 52c' for holding the second group of batteries 26c'. The first pocket portion 52c extends through a first battery opening 48c and the second pocket portion 52c' extends through a second battery opening 48c' in the second section 36c of the first panel 12c. Once the first section 34c of the first panel 12c is connected to the second section 36c of the first panel 12c, the first pocket portion 52c and the second pocket portion 52c' will extend from the first front surface 16c of the first panel 12c. It is noted that in this embodiment, the first tear away strip 104c is located below the second light receiving opening 50c in the first section 34c of the first panel 12c instead of to the side of the second light receiving opening 50c (as illustrated in the first embodiment of the package 10) to allow access to the batteries 26c, 26c'.

In the forgoing description, it will be readily appreciated by those skilled in the art that modifications may be made to the invention without departing from the concepts disclosed herein. For example, any portable electrically operated device could be held in the package 10 instead of or in addition to the light device. Moreover, it is contemplated that the battery holder could include two portions (like the light device holder) and extend from both the first front surface of the first panel and the second rear surface of the second panel (with additional openings in the second panel for the accommodating the battery holder). It is further contemplated that the two sections of the light device holder could be hinged instead of separate. Moreover, it is contemplated that the first panel and the second panel could have any peripheral configuration (e.g., square, rectangular, curved sides, etc.). Additionally, it is contemplated that all surfaces of the first panel and the second panel could have instructions or other information regarding the light device and the at least one battery. Furthermore, it is contemplated that the package could have only the at least one battery viewable from the front or neither the at least one battery nor the light device viewable from the front of the package. Such modifications are to be considered as included in the following claims, unless these claims by their language expressly state otherwise.

We claim:

1. A package comprising:

a first panel having a first front surface and a first rear surface; and a second panel pivotally connected to the first panel, the second panel having a second front surface and a second rear surface;

the first panel and the second panel having a closed position wherein the first panel abuts the second panel such that the first rear surface of the first panel abuts the second front surface of the second panel;

the first panel and the second panel having an open position wherein the first rear surface of the first panel is spaced from the second front surface of the second panel;

the first panel having an at least partially transparent battery holder, the battery holder being configured to retain at least one battery therein, the battery holder being configured to allow the at least one battery to be seen from a front of the package when the first panel and the second panel are in the closed position;

the second panel having an at least partially transparent device holder, the device holder being configured to retain a device therein, the device holder being configured to allow the device to be seen from the front of the package when the first panel and the second panel are in the closed position, the device holder further being configured to allow the device to be seen from the second front surface of the second panel when the first panel and the second panel are in the open position; and at least one of the first panel and the second panel includes a first section defining the front surface of the panel and a second section defining the rear surface of the panel, wherein at least one of the battery holder and the device holder is captured between the first and second sections of the corresponding first and second panels, respectively.

2. The package of claim 1, wherein:

the first panel has a first tear away strip at the first rear surface for allowing the at least one battery in the battery holder to be removed from the first panel when the first panel and the second panel are in the open position.

3. The package of claim 2, wherein:

the second panel has a second tear away strip at the second front surface for allowing the device in the device holder to be removed from the second panel when the first panel and the second panel are in the open position.

4. The package of claim 3, wherein:

the first panel includes a first tab on a side thereof for pulling the first tear away strip at least partially away from the rest of the first panel; and the second panel includes a second tab on a side thereof for pulling the second tear away strip at least partially away from the rest of the second panel.

5. The package of claim 1, wherein:

the second panel has a second tear away strip at the second front surface for allowing the device in the device holder to be removed from the second panel when the first panel and the second panel are in the open position.

6. The package of claim 4, wherein:

at least a portion of the device holder is connected to the second tear away strip.

7. The package of claim 1, wherein:

the first panel includes a first panel first section defining the first front surface and a first panel second section defining the first rear surface; and the battery holder is captured between the first panel first section and the first panel second section.

8. The package of claim 7, wherein:

the second panel includes a second panel first section defining the second front surface and a second panel second section defining the second rear surface; and the device holder is captured between the second panel first section and the second panel second section.

9. The package of claim 1, wherein:

the second panel includes a second panel first section defining the second front surface and a second panel second section defining the second rear surface; and the device holder is captured between the second panel first section and the second panel second section.

10. The package of claim 1, wherein:

the device holder extends through an opening in the first panel.

11. The package of claim 1, wherein:

the device holder is further configured to allow the device to be seen from a rear of the second panel when the first panel and the second panel are in the closed position.

12. A package comprising:

a first panel having a first front surface and a first rear surface; and a second panel pivotally connected to the first panel, the second panel having a second front surface and a second rear surface;

the first panel and the second panel having a closed position wherein the first panel abuts the second panel such that the first rear surface of the first panel abuts the second front surface of the second panel;

the first panel and the second panel having an open position wherein the first rear surface of the first panel is spaced from the second front surface of the second panel;

the first panel having an at least partially transparent battery holder and at least one battery in the battery holder, the battery holder being configured to allow the at least one battery to be seen from a front of the package when the first panel and the second panel are in the closed position;

the second panel having an at least partially transparent battery powered device holder and a battery powered device retained by the battery powered device holder, the battery powered device holder being configured to allow the battery powered device to be seen from the front of the package when the first panel and the second panel are in the closed position, the battery powered device holder further being configured to allow the battery powered device to be seen from the second front surface of the second panel when the first panel and the second panel are in the open position; and at least one of the first panel and the second panel includes a first section defining the front surface of the panel and a second section defining the rear surface of the panel, wherein at least one of the battery holder and the device holder is captured between the first and second sections of the corresponding first and second panels, respectively.

13. The package of claim 12, wherein:

the first panel has a first tear away strip at the first rear surface for allowing the at least one battery in the battery holder to be removed from the first panel when the first panel and the second panel are in the open position.

14. The package of claim 13, wherein:

the second panel has a second tear away strip at the second front surface for allowing the battery powered device in the battery powered device holder to be removed from the second panel when the first panel and the second panel are in the open position.

15. The package of claim 14, wherein:

the first panel includes a first tab on a side thereof for pulling the first tear away strip at least partially away from the rest of the first panel; and the second panel includes a second tab on a side thereof for pulling the second tear away strip at least partially away from the rest of the second panel.

16. The package of claim 12, wherein:

the second panel has a second tear away strip at the second front surface for allowing the battery powered device in the battery powered device holder to be removed from the second panel when the first panel and the second panel are in the open position.

17. The package of claim 16, wherein:

at least a portion of the device holder is connected to the second tear away strip.

18. The package of claim 12, wherein:

the first panel includes a first panel first section defining the first front surface and a first panel second section defining the first rear surface; and the battery holder is captured between the first panel first section and the first panel second section.

19. The package of claim 18, wherein:

the second panel includes a second panel first section defining the second front surface and a second panel second section defining the second rear surface; and the battery powered device holder is captured between the second panel first section and the second panel second section.

20. The package of claim 12, wherein:

the second panel includes a second panel first section defining the second front surface and a second panel second section defining the second rear surface; and the battery powered device holder is captured between the second panel first section and the second panel second section.

21. The package of claim 12, wherein:

the battery powered device holder extends through an opening in the first panel.

22. The package of claim 12, wherein:

the at least one battery comprises a plurality of batteries.

23. The package of claim 12, wherein:

the battery powered device comprises a light device for emitting light.

24. The package of claim 12, wherein:

the battery powered device holder is further configured to allow the battery powered device to be seen from a rear of the second panel when the first panel and the second panel are in the closed position.

25. A package comprising:

a first panel having a first front surface and a first rear surface; and a second panel pivotally connected to the first panel, the second panel having a second front surface and a second rear surface;

the first panel and the second panel having a closed position wherein the first panel abuts the second panel such that the first rear surface of the first panel abuts the second front surface of the second panel;

the first panel and the second panel having an open position wherein the first rear surface of the first panel is spaced from the second front surface of the second panel;

the first panel having a battery holder, the battery holder being configured to retain at least one battery therein;

the second panel having a device holder, the device holder being configured to retain a device therein;

the first panel having a first tear away strip at the first rear surface for allowing the at least one battery in the battery holder to be removed from the first panel when the first panel and the second panel are in the open position; and the second panel having a second tear away strip at the second front surface for allowing the device in the device holder to be removed from the second panel when the first panel and the second panel are in the open position, wherein at least a portion of the device holder is connected to the second tear away strip.

26. The package of claim 25, wherein:

the battery holder is configured to allow the at least one battery to be seen from a front of the package when the first panel and the second panel are in the closed position; and the device holder is configured to allow the device to be seen from the front of the package when the first panel and the second panel are in the closed position, the device holder further being configured to allow the device to be seen from the front of the second panel when the first panel and the second panel are in the open position.

27. The package of claim 26, wherein:

the device holder is further configured to allow the device to be seen from a rear of the second panel when the first panel and the second panel are in the closed position.

28. The package of claim 25, wherein:

the first panel includes a first panel first section defining the first front surface and a first panel second section defining the first rear surface; and the battery holder is captured between the first panel first section and the first panel second section.

29. The package of claim 28, wherein:

the second panel includes a second panel first section defining the second front surface and a second panel second section defining the second rear surface; and the device holder is captured between the second panel first section and the second panel second section.

30. The package of claim 25, wherein:

the second panel includes a second panel first section defining the second front surface and a second panel second section defining the second rear surface; and the device holder is captured between the second panel first section and the second panel second section.

31. The package of claim 25, wherein:

the device holder extends through an opening in the first panel.

32. The package of claim 25, wherein:

the first panel includes a first tab on a side thereof for pulling the first tear away strip at least partially away from the rest of the first panel; and the second panel includes a second tab on a side thereof for pulling the second tear away strip at least partially away from the rest of the second panel.

33. A package comprising:

a first panel having a first front surface and a first rear surface; and a second panel pivotally connected to the first panel, the second panel having a second front surface and a second rear surface;

the first panel and the second panel having a closed position wherein the first panel abuts the second panel such that the first rear surface of the first panel abuts the second front surface of the second panel;

the first panel and the second panel having an open position wherein the first rear surface of the first panel is spaced from the second front surface of the second panel;

the first panel having a battery holder retaining at least one battery;

the second panel having a battery powered device holder retaining a battery powered device;

the first panel having a first tear away strip at the first rear surface for allowing the at least one battery in the battery holder to be removed from the first panel when the first panel and the second panel are in the open position; and the second panel having a second tear away strip at the second front surface for allowing the battery powered device in the battery powered device holder to be removed from the second panel when the first panel and the second panel are in the open position.

34. The package of claim 33, wherein:

the battery holder is configured to allow the at least one battery to be seen from a front of the package when the first panel and the second panel are in the closed position; and the battery powered device holder is configured to allow the battery powered device to be seen from the front of the package when the first panel and the second panel are in the closed position, the battery powered device holder further being configured to allow the battery powered device to be seen from the front of the second panel when the first panel and the second panel are in the open position.

35. The package of claim 34, wherein:

the battery powered device holder is further configured to allow the device to be seen from a rear of the second panel when the first panel and the second panel are in the closed position.

36. The package of claim 33, wherein:

the first panel includes a first panel first section defining the first front surface and a first panel second section defining the first rear surface; and the battery holder is captured between the first panel first section and the first panel second section.

37. The package of claim 36, wherein:

the second panel includes a second panel first section defining the second front surface and a second panel second section defining the second rear surface; and the battery powered device holder is captured between the second panel first section and the second panel second section.

38. The package of claim 33, wherein:

the second panel includes a second panel first section defining the second front surface and a second panel second section defining the second rear surface; and the battery powered device holder is captured between the second panel first section and the second panel second section.

39. The package of claim 33, wherein:

the battery powered device holder extends through an opening in the first panel.

40. The package of claim 33, wherein:

the at least one battery comprises a plurality of batteries.

41. The package of claim 33, wherein:

the battery powered device comprises a light device for emitting light.

42. The package of claim 33, wherein:

the first panel includes a first tab on a side thereof for pulling the first tear away strip at least partially away from the rest of the first panel; and the second panel includes a second tab on a side thereof for pulling the second tear away strip at least partially away from the rest of the second panel.

43. The package of claim 33, wherein:

at least a portion of the battery powered device holder is connected to the second tear away strip.

* * * * *